United States Patent [19]

Simpson

[11] 4,174,563

[45] Nov. 20, 1979

[54] WIRE WRAP POST TERMINATOR FOR STRANDED WIRE

[75] Inventor: Damon G. Simpson, Los Altos, Calif.

[73] Assignee: Raychem Corporation, Menlo Park, Calif.

[21] Appl. No.: 859,273

[22] Filed: Dec. 12, 1977

[51] Int. Cl.[2] ..... H01R 5/04

[52] U.S. Cl. ..... 29/628; 174/90; 174/94 R; 174/DIG. 8; 228/245; 228/904; 339/DIG. 1

[58] Field of Search ..... 29/628; 403/28, 272, 403/273; 228/904, 245, 246, 56; 339/275 R, 275 B, DIG. 1; 174/35 C, 84 R, DIG. 8, 90, 94 R

[56] References Cited

U.S. PATENT DOCUMENTS

| | | | |
|---|---|---|---|
| 3,239,125 | 3/1966 | Sherlock | 29/630 R |
| 3,243,211 | 3/1966 | Wetmore | 287/78 |
| 3,305,625 | 2/1967 | Ellis | 174/84 R |
| 3,312,772 | 4/1967 | Sherlock | 174/75 |
| 3,316,343 | 4/1967 | Sherlock | 174/84 R |
| 3,396,460 | 8/1968 | Wetmore | 29/629 |
| 3,525,799 | 8/1970 | Ellis | 174/84 R |
| 3,541,495 | 11/1970 | Ellis | 339/177 |
| 3,678,174 | 7/1972 | Ganzhorn | 174/84 R |
| 3,721,749 | 3/1973 | Clabburn | 174/88R |
| 3,836,947 | 9/1974 | Yeager | 339/259 R |
| 3,995,964 | 12/1976 | De Groef | 174/DIG. 8 |

FOREIGN PATENT DOCUMENTS

| | | | |
|---|---|---|---|
| 1270367 | 4/1972 | United Kingdom | 339/1 |
| 1470049 | 4/1977 | United Kingdom . | |

*Primary Examiner*—Francis S. Husar
*Assistant Examiner*—Gene P. Crosby
*Attorney, Agent, or Firm*—Lyon & Lyon

[57] ABSTRACT

Described herein is an improved connector sleeve and a method of forming wire wrap post terminations with this connector sleeve. The sleeve comprises a solder ring and a fixturing member positioned in an axially displaced relationship within a heat recoverable sleeve such that the fixturing member and the solder ring are held in place by the heat recoverable sleeve.

19 Claims, 3 Drawing Figures

WIRE WRAP POST TERMINATOR FOR STRANDED WIRE

BACKGROUND OF THE INVENTION

The burgeoning electrical component industry is in constant need of easier and quicker methods of making electrical connections. With labor costs continually rising, there is a great desire to streamline these procedures and avoid unnecessary delays in production. One of the difficulties faced by those in the field is the problem of making a number of electrical connections in close proximity such as in computers and other complex electrical components. Many of these connections are quite small and the lack of adequate working area within the component is a source of many delays. Another factor that poses difficulty is the necessity of a secure electrical connection that is not affected by the jostling of daily operation. As a result, in many electrical components such as printed circuit boards and the like, there is a great need for a means of forming good connections quickly and with a high degree of conduction.

One useful method of forming a connection is used frequently in printed circuit boards. This method utilizes square or rectangular cross-section wire wrap posts as termination points. The end of a solid wire is stripped of insulation and with the aid of a winding tool the exposed conductor is tightly wound around the post approximately five complete turns. Tight winding of the wire provides excellent electrical contact at the corners of the post where the pressure of the conductor on the post is quite high. In some applications when a properly sized solid wire is so terminated, it is generally unnecessary to employ solder to ensure a reliable electrical connection. However, where a permanent connection is desired such a termination can be soldered.

Although this technique is reliable and quite effective for many applications, its feasibility is limited to solid wires. Stranded wires, unfortunately, do not remain tightly wound to the post and consequently produce unsatisfactory connections with this wire wrapping technique. This is in part because each strand of wire does not engage all four of the sharp edges on the post with each full turn.

Generally, solid wires do not withstand shock and vibration as well as stranded wires and in selected applications, such as in airborne electric equipment for example, there is a definite need for a method of satisfactorily terminating a stranded conductor to a wire wrap post on a printed circuit board.

A number of connectors have been developed to terminate a stranded conductor to a wire wrap post. Examples of such connectors can be found in U.S. Pat. No. 3,836,947 and U.S. Patent Application Ser. No. 497,709 filed Aug. 15, 1974, now abandoned, the disclosures of which are incorporated by reference herein. Solder can provide a high quality electrical and mechanical connection between a stranded conductor and a wire wrap post. However, positioning and holding the stranded conductor in the desired relationship with respect to the post during the soldering operation frequently presents serious problems. Limited space between a plurality of posts combined with the presence of other wires interfere with the use of tools, such as needle nose pliers, to fixture a stranded conductor to a post during soldering. Even though in some situations a stranded wire can be wrapped around a post to temporarily fixture the wire during soldering, this wrapping and soldering results in an unnecessarily bulky mass of material in the resulting connection. Thus the need for a simple means of forming a solder connection between a stranded conductor and a wire wrap post without the necessity of a hand-held fixturing tool to hold the stranded wire to the post is very substantial.

Electrical connections utilizing solder are well known. U.S. Pat. Nos. 3,239,125, 3,243,211, 3,525,799, 3,396,460 and 3,305,625, for instance, show different variations of solder rings or balls of solder within heat recoverable members useful in forming various electrical connections. Many connectors employing solder, however, are specifically adapted to the particular electrical components with which they are used. U.S. Pat. No. 3,312,772, for example, shows shield termination devices comprising a recoverable member, a solder insert and an insert comprising a metal foil. Similarly, U.S. Pat. No. 3,316,343 teaches connectors for use in joining flat electrical conductors with a flat rectangular solder insert. Terminal pins provided with solder that may be coated on the pin or deposited in a recess may be found in U.S. Pat. No. 3,324,230. Likewise, in U.S. Pat. No. 3,541,495 there is exhibited a coaxial contact for terminating both the central conductor and the braided shield of a coaxial cable with solder connections. Contact is provided with an internal sleeve of heat recoverable material having a solder insert. Other variations on this central theme may be found in U.S. Pat. Nos. 3,678,174, 3,721,749 and 3,852,517. The disclosures of each of these patents are incorporated herein by reference.

BRIEF SUMMARY OF THE INVENTION

The primary object of the present invention is to provide a means and a method for forming highly effective connections between a stranded wire conductor and a wire wrap post.

A further object of this invention is to provide a means for forming a highly effective connection without requiring that the stranded wire conductor be held in contact with the wire wrap post by means of a hand-held fixturing tool while the solder is solidifying.

Other objects and advantages of the present invention will be apparent from the following detailed description of the invention.

DETAILED DESCRIPTION OF THE INVENTION

Figure 1:
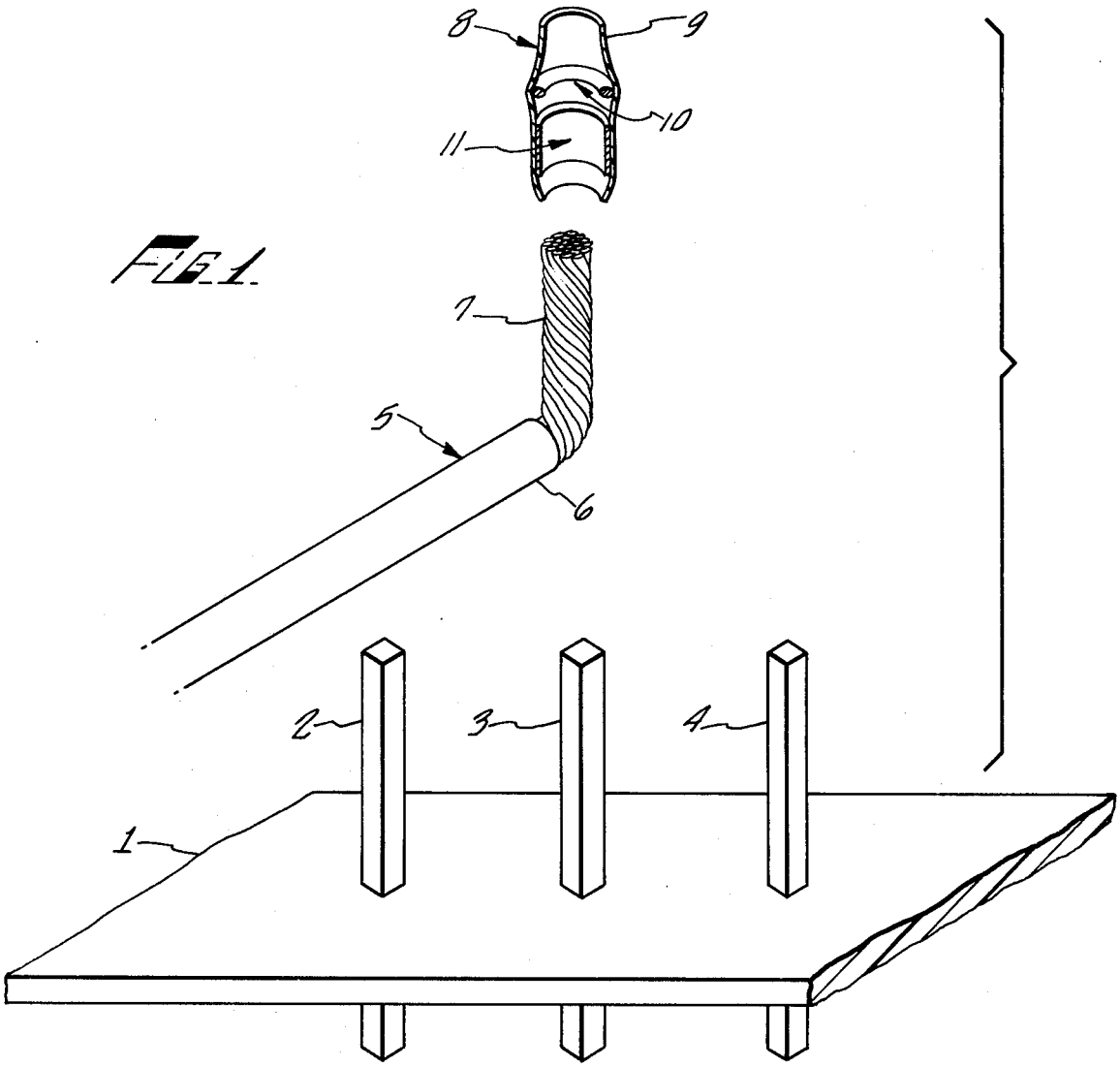
FIG. 1 shows a wire wrap post, a stranded wire conductor and a cut-away portion of a connector sleeve of the present invention prior to assembly.

Described herein is an improved connector sleeve and a method of making a connection using this sleeve which eliminates the use of a hand-held fixturing tool while awaiting solidification of the solder. FIG. 1 illustrates a circuit board 1 having three wire wrap posts 2, 3 and 4. Positioned above the circuit board is a length of stranded wire conductor 5 with a portion of its insulation 6 removed at 7. Directly above the stranded wire and shown in cut-away perspective is a heat recoverable connector sleeve 8 according to the present invention. The sleeve may also be either closed at one end thus forming a cap or open on both ends. This sleeve comprises three elements. A heat recoverable sleeve 9 surrounds an insert of solder or other fusible agent shown as a ring 10 and a fixturing member 11. The fixturing member can comprise an annulus of a material that will not melt at a temperature at or below either the melting point of the solder or the recovery temperature of the heat recoverable sleeve. Preferably the fixturing member comprises a metallic annulus although suitable plastic materials can also be used. More preferably, the fixturing member comprises a brass or copper annulus. Still more preferably, such a brass or copper fixturing member is coated, for example, with a thin layer of solder, tin, silver or the like. The fixture member forces the stranded wire into close contact with the wire wrap post. Normally the wire is initially inserted into the sleeve followed by forcing the sleeve and connector assembly onto the post. This causes the fixturing member to deform slightly thereby wedging the wire strands between the fixturing member and the post. This permits a considerable number of the strands to be in contact with the wire wrap post and provides for a good electrical connection after soldering. Naturally, these same principles may be employed for many other substrates.

The fixturing member provides other benefits in addition to aiding in the formation of a good electrical connection. For example, once the termination has been formed, the presence of the fixturing member reinforces the solder and ensures that jostling will not separate the stranded wire from the post. The fixturing member also provides strain relief where the wire emanating from the post must be kept taut.

The fixturing member of the present invention may be readily distinguished from the connector suitable for splicing and terminating the ends of electrical conduits shown in FIG. 8 of U.S. Pat. No. 3,243,211. Shown in this patent is a rigid sleeve inserted within a fusible member. A recoverable member surrounds the fusible member, with the presence of solder within the rigid sleeve optional.

Materials suitable for making heat recoverable sleeves are well known. In Cook, U.S. Pat. No. 3,086,242, for example, the disclosure of which is incorporated herein by reference, there is described a variety of suitable materials, e.g., cross-linked polymers.

Figure 2:
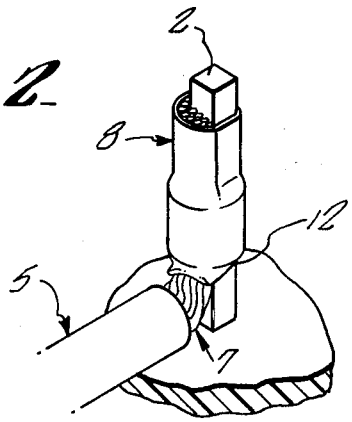
FIG. 2 exhibits the stranded wire wrap post termination upon recovery of the outer heat recoverable sleeve and flowing of the solder.
Figure 3:
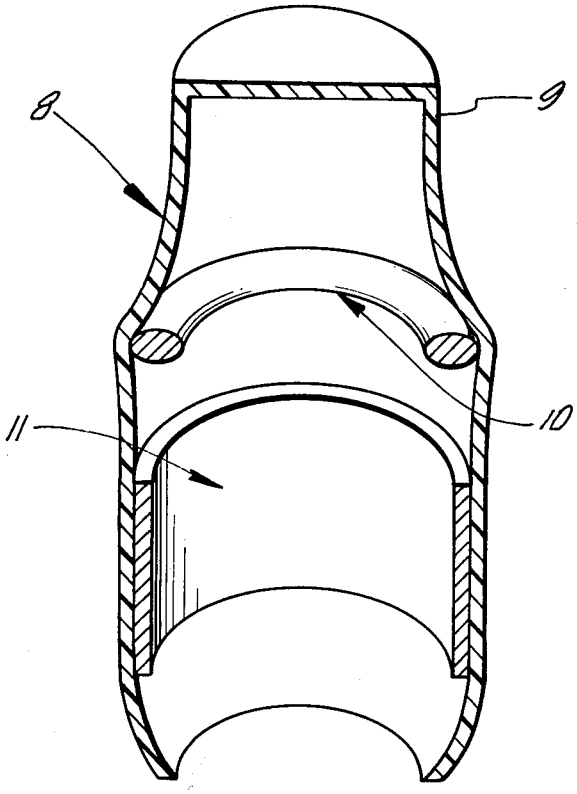
FIG. 3 shows the heat recoverable sleeve closed at one end.

Illustrated in FIG. 2 is the assembly of the present invention after recovery of the heat recoverable sleeve and solidification of the solder. During operation, the insulation-free portion 7 of the stranded wire is inserted into the fixturing member end 12 of the sleeve 8. The stranded wire may also be inserted into the opposite end of the sleeve (not shown). The sleeve and the stranded wire are thereupon pushed over the wire wrap post 2. Once in place, the sleeve, stranded wire and wire wrap post are heated to yield an insulated solder termination. The assembly may be heated in any suitable manner such as, for example, with a stream of heated air, however, space limitations frequently require that heat be applied to the upper portion. In those instances, once the solder has melted it is drawn to the heat and flows along the stranded wire. This provides a greater bond area that ensures a strong connection.

The timesaving characteristics of this invention are manifest. No longer need the operator hold each potential termination with a fixturing tool while waiting for the solder to solidify. Here the connector sleeves may be inserted with the wire in place over the wire wrap post followed by mass heating of the termination thus freeing the laborer for other tasks. Another important aspect of this invention is that it eliminates the separate step of placing an insulator about the wire wrap post termination. Here, the insulation, i.e., the heat recoverable sleeve, is an integral part of the connector sleeve and is applied at the time the solder ring is positioned over the wire wrap post.

Besides eliminating the separate step of insulating the termination, the present invention also provides a more compact termination than is ordinarily obtained with hand soldering methods. Hand soldering without a fixturing tool requires a 360° wrap of conductor around the post in order to provide a good connection. This, however, has the concomitant effect of creating a bulky connection that is difficult to insulate. The connector sleeve of this invention avoids this deleterious aspect of the prior art and provides a smooth insulated connection.

While embodiments and applications of this invention have been shown and described, it will be apparent to those skilled in the art that many more modifications are possible without departing from the inventive concepts herein described. The invention, therefore, is not to be restricted except as it is necessary by the prior art and by the spirt of the appended claims.

I claim:

1. A method of forming a wire wrap post termination which comprises:

a. removing the insulation from an end portion of a stranded wire;

b. threading said end portion of the stranded wire into a connector, said connnector comprising a solder insert and a fixturing member positioned in axially displaced relationship within a heat recoverable sleeve such that said fixturing member and said solder insert are held in place by said heat recoverable sleeve;

c. inserting a wire wrap post into said connector sleeve, such that the stranded wire is wedged between the post and the fixturing member of the connector; and d. heating the assembly at a temperature sufficient to melt the solder and occasion recovery of the heat recoverable sleeve without melting the fixturing member.

2. The method according to claim 1 wherein the upper postion of said assembly is heated, causing the solder to flow toward the heat.

3. The method of claim 1 wherein said solder insert comprises a solder ring and said fixturing member and said solder ring have substantially the same inner diameter.

4. The method according to claim 3 wherein said fixturing member is a tube.

5. The method according to claim 4 wherein said fixturing member is metallic.

6. The method according to claim 4 wherein said fixturing member is plastic.

7. In a connector for joining substrates which comprises a solder insert positioned within a heat recoverable sleeve, the improvement comprising a fixture member positioned within the heat recoverable sleeve in axially displaced relationship from the solder insert, wherein the fixturing member and the solder insert are held in place by the heat recoverable sleeve and wherein the fixturing member does not melt at a temperature at or below either the melting point of the solder or the recovery temperature of the heat recoverable sleeve, the fixturing member being adapted for wedging two substrates together.

8. The connector sleeve according to claim 7 wherein the heat recoverable sleeve is closed at one end.

9. The connector sleeve of claim 7 wherein said solder insert comprises a solder ring and said fixturing member and said solder ring have substantially the same inner diameter.

10. The connector sleeve according to claim 9 wherein said fixturing member is metallic.

11. The connector sleeve according to claim 9 wherein said fixturing member is plastic.

12. A method of forming a termination which comprises:

a. threading an end portion of a first substrate into a connector, said connector comprising an insert of a fusible agent and a fixturing member positioned in axially displaced relationship within a heat recoverable sleeve such that said fixturing member and said fusible agent are held in place by said heat recoverable sleeve;

b. inserting a second substrate into said connector, such that the first substrate is wedged against the second substrate by the fixturing member of the connector; and c. heating the assembly at a temperature sufficient to melt the fusible agent and occasion recovery of the heat-recoverable sleeve without melting the fixturing member.

13. The method according to claim 12 wherein the upper portion of said assembly is heated, causing the fusible agent to flow toward the heat.

14. The method of claim 1 wherein the fixturing member does not melt at a temperature at or below either the melting point of the solder or the recovery temperature of the heat recoverable sleeve.

15. The method of claim 12 wherein the fixturing member does not melt at a temperature at or below either the melting point of the solder or the recovery temperature of the heat recoverable sleeve.

16. The method of claim 12 wherein said fusible agent comprises a fusible ring and said fixturing member and said fusible ring have substantially the same inner diameter.

17. The method according to claim 16 wherein said fixturing member is tubular.

18. The method according to claim 17 wherein said fixturing member is metallic.

19. The method according to claim 17 wherein said fixturing member is plastic.

* * * * *